United States Patent [19]

Wenman et al.

[11] Patent Number: 4,861,273

[45] Date of Patent: Aug. 29, 1989

[54] LOW-VOLTAGE MINIATURE TRACK LIGHTING SYSTEM

[75] Inventors: James A. Wenman, Holland, Mich.; Douglas Bray, Riverside, N.J.; David H. Porter, Cleveland, Ohio

[73] Assignee: Thomas Industries, Inc., Louisville, Ky.

[21] Appl. No.: 108,087

[22] Filed: Oct. 13, 1987

[51] Int. Cl.[4] ..... H01R 25/14

[52] U.S. Cl. ..... 439/111; 439/115; 439/122; 174/70 C

[58] Field of Search ..... 439/207–216, 439/110–122; 174/70 C; 191/23 A; 362/801

[56] References Cited

U.S. PATENT DOCUMENTS

| | | | |
|---|---|---|---|
| 1,885,513 | 11/1932 | DeMask | 439/116 |
| 2,026,884 | 1/1936 | Glasgow | 191/23 A |
| 2,856,592 | 10/1958 | Carlson | 439/119 |
| 3,529,275 | 9/1970 | Routh | 439/118 |
| 4,533,190 | 8/1985 | Booty | 439/110 |
| 4,676,567 | 6/1987 | Mouchi | 439/116 |

FOREIGN PATENT DOCUMENTS

| | | | |
|---|---|---|---|
| 0882908 | 11/1961 | United Kingdom | 439/116 |
| 1401300 | 7/1975 | United Kingdom | 439/207 |
| 2185863 | 7/1987 | United Kingdom | 439/119 |

*Primary Examiner*—Gary F. Paumen

*Attorney, Agent, or Firm*—Hill, Van Santen, Steadman & Simpson

[57] ABSTRACT

A low voltage track lighting system includes a flexible power track and one or more light fixtures removably attachable to the track for energization. The track has an elongated support member of an electrical insulating material, the support member being generally I-shaped, defining lateral electrical conductor-receiving channels, the conductors being flat strips extending on-end along the sides of the support member and exposed therealong, the conductor orientation enabling the power track to be bent in a horizontal plane, but not in a vertical plane. Each light fixture includes a power head connector including a two-piece housing including a base member which mounts a pair of contacts and a slide member adapted to slide along the outer surface of the base member and drive the contacts into engagement with the track conductors to mechanically and electrically connect the light fixture to the power track which is electrically connected to a source of power through a transformer module which is hard-wired to the power source or adapted for mounting with an existing recessed light housing and provided with a male socket adapter which is screwed into the lamp socket within the recessed housing.

23 Claims, 4 Drawing Sheets

FIG. 7
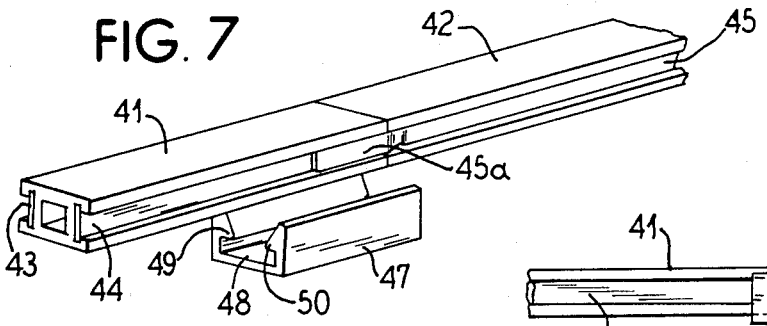
FIG. 8
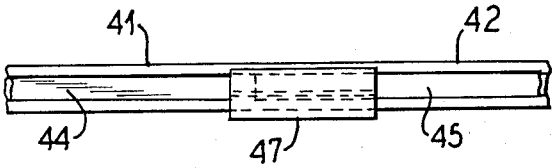
FIG. 9
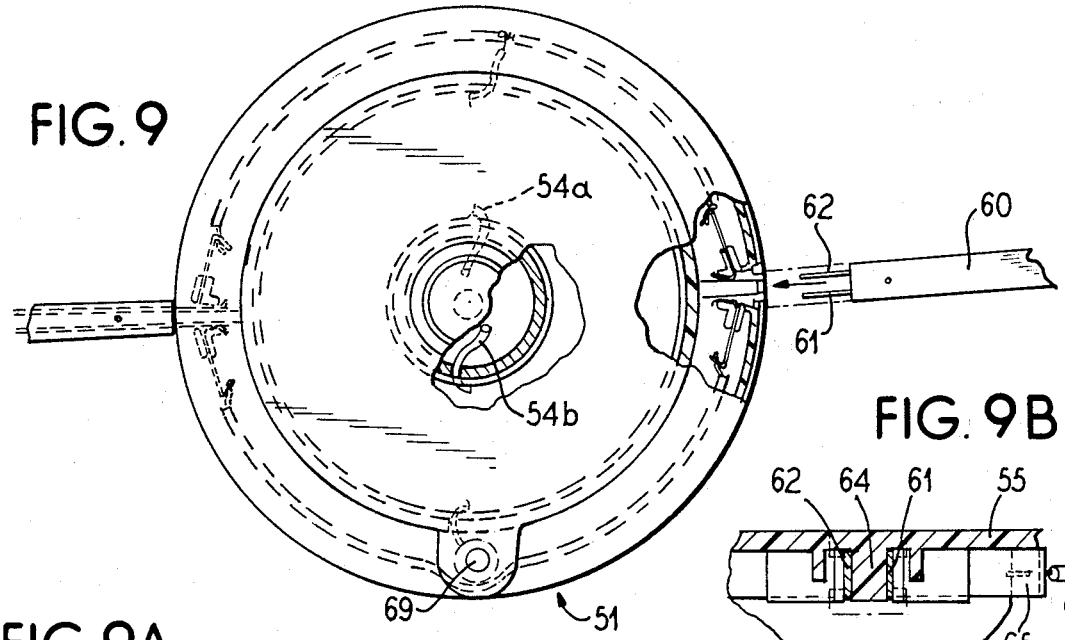
FIG. 9B
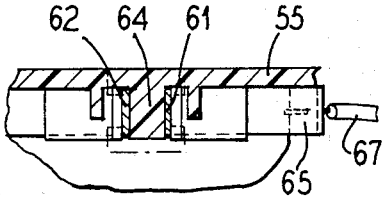
FIG. 9A
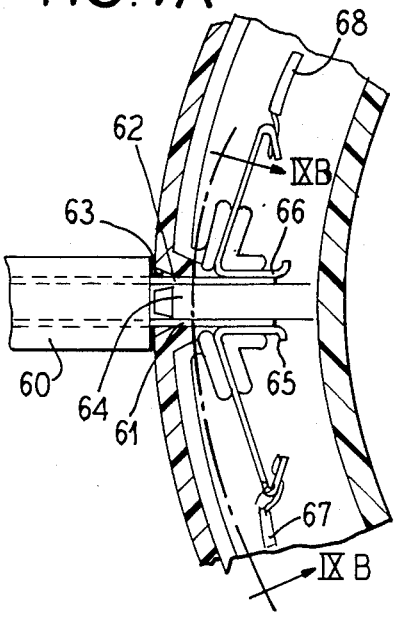
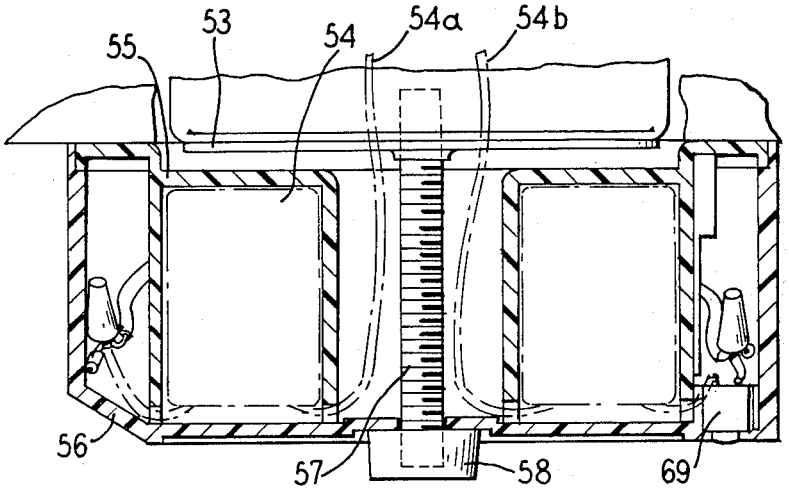
FIG. 10

LOW-VOLTAGE MINIATURE TRACK LIGHTING SYSTEM

BACKGROUND OF THE INVENTION

Field of the Invention

This invention relates to track lighting systems, and more particularly to a minaturized, low-voltage track lighting system.

Track lighting systems have become increasingly popular in recent years because of their flexibility in locating light fixtures within a room, and their ability to relocate any of the light fixtures within limits established by the extent of the track.

In conventional track lighting systems, the track consists of an elongated channel member which maintains and mounts a pair of electric conductors to a surface wall in electrically insulating relation with one another and with the channel member. Light fixtures are removably attachable to the track by power head assemblies which both secure the light fixture to the track and extend electrical power carried by the supply conductors to the lamp of the light fixture. The fixtures are initially positioned at any location along the length of the track and may be repositioned anywhere along the track as required by lighting needs or aesthetics.

Known track lighting systems afford a degree of flexibility in the location and relocation of light fixtures within a room. However, because known systems provide only straight elongated track, all light fixtures for a given track must be aligned in a straight line. Adaptors have been provided in some systems to enable right angle connections between a pair of track sections, or allowing two track sections to be connected together end to end to extend the length of the overall track assembly.

A further consideration is that initially track lighting systems were powered directly from existing wiring, typically 110 VAC. Thus, high voltage lamps and other devices were required in such systems. The trend towards the use of high intensity, low voltage lamps as a means for reducing energy costs dictates a need for a track lighting system which is usable with low voltage lamps, and the like. It would also be desirable to have a track lighting system which is flexible in application, easy to install and low in cost.

SUMMARY OF THE INVENTION

It is an object of the invention to provide a track lighting system characterized by flexibility of application, ease of installation and low cost.

Another object of the invention is to provide an improved low voltage track lighting system.

Another object of the invention is to provide an improved power track for track lighting systems.

In accordance with the present invention, a track lighting system comprises power track means, power means and a light fixture assembly. The power track means includes an elongated support member of an electrical insulating material having first and second channels in opposite sides thereof and extending the length of the support member, and first and second elongated strip conductors of electrically conducting material supported in said first and second channels, respectively, the conductors being oriented vertically widthwise and extending substantially the entire length of the channels. The power means couples the strip conductors to a source of electrical power for energizing the conductors. The light fixture assembly includes socket means for receiving a lamp, power head connector means connected to said socket means and support means for supporting at least the power head connector means. The power head connector means includes a two-piece housing having a base member and a slide member, and first and second flexible electrical contacts, the contacts having mounting portions and contact portions. The base member defines mounting channels for mounting the contacts by their mounting portions in a parallel spaced relation at opposite sides of the base member. The slide member is mounted on the base member for slidable movement along the outer surface thereof between a release position and a latch position flexing the contact portions of the contact towards one another into engagement with the strip conductors for connecting the light fixture assembly to the power track means mechanically and electrically by the contact. The slide member is movable between the latch position and the release position to disengage from the contact portions, allowing them to flex away from one another to disconnect the light fixture assembly from the power track means.

In accordance with the invention, the support member and the conductors supported thereby are bendable in a first plane, but the vertically oriented conductors prevent bending of the support member in plane perpendicular to the first plane.

The power means includes a voltage step-down transformer means, coupling the strip conductors to a source of electrical power for energizing the strip conductors and means mounting the transformer means within a recessed fixture. The transformer means has an input circuit including a male socket adapter adapted to be received in a socket of the recessed fixture, an output circuit including first and second contact means constructed and arranged to engage the first and second strip conductors, respectively, extending electrical power thereto, and a cover means mounted on an open end of the recessed fixture for enclosing the transformer means therewithin.

Further in accordance with the invention, the power means includes a voltage step down transformer means coupling the strip conductors to a source of electrical power for energizing the strip conductors, the power transformer means having an input circuit hard-wired to a source of electrical power and an output circuit including first and second contact means constructed and arranged to engage the first and second strip conductors, respectively, extending electrical power thereto, and housing means enclosing the transformer means and adapted for attachment to a surface.

BRIEF DESCRIPTION OF THE DRAWINGS

FIG. 7 is a partially exploded view illustrating a pair of sections of track and a connector adapted to interconnect and hold together the two sections.

FIG. 8 is an assembled view of the track assembly of FIG. 7.

FIG. 9 is an elevational view, partially cut away, of a surface mounted transformer for supplying power to a section of track.

FIG. 9A is an enlarged view of the cut away area of FIG. 9.

FIG. 9B is a sectional view taken generally along the line IXB—IXB of FIG. 9A.

FIG. 10 is a cross-sectional view of the transformer of FIG. 9.

.

DESCRIPTION OF THE PREFERRED EMBODIMENTS

Figure 1:
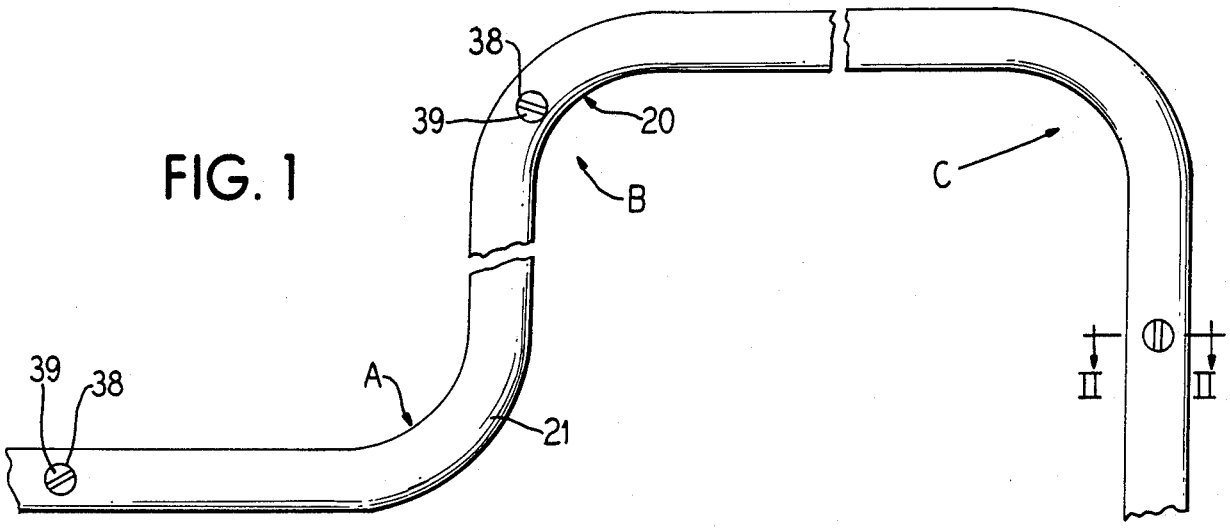
FIG. 1 is a top plan view of a track provided by the present invention, shown installed on a ceiling or surface.
Figure 2:
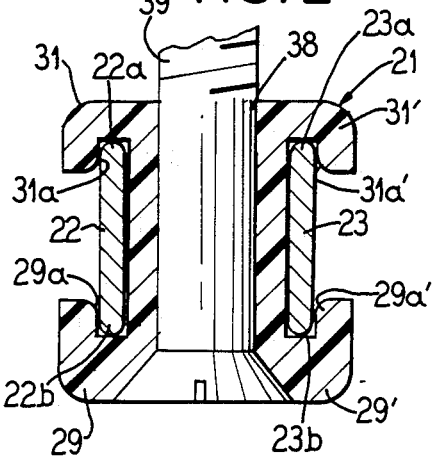
FIG. 2 is a sectional view of the track taken along the lines II—II in FIG. 1.
Figure 3:
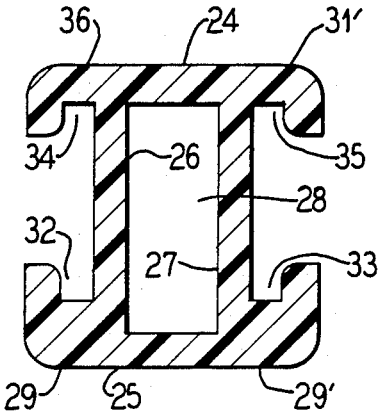
FIG. 3 is a cross-sectional view of the track with the supply conductors removed.
Figure 4:
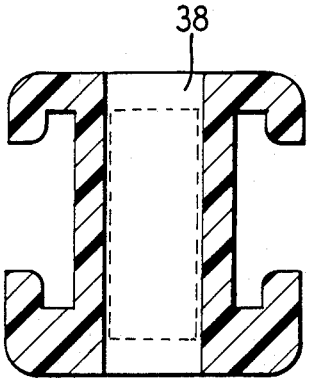
FIG. 4 is a sectional view of a portion of the track illustrating the mounting hole.

Referring to FIGS. 1–4, there is illustrated a track assembly 20 for a track lighting system provided by the present invention. As best shown in FIG. 2, the power track assembly 20 includes a support member 21 of electrically insulating material, and a pair of supply conductors 22, 23. Referring to FIG. 3, the support member 21 has a generally I-shaped cross-section including top portion or wall 24 and bottom portion or wall 25 interconnected by a pair of vertically extending ribs 26 and 27 which are spaced apart defining a hollow center or cavity 28 along the entire length of the support member 21.

A pair of shoulders 29 and 29′ extend laterally outward from rib members 26 and 27, respectively near the bottom edges thereof. Similarly, shoulders 31 and 31′ extend laterally outwardly from rib members 26 and 27 near the upper edges thereof. Shoulders 29 and 29′ have channels 32 and 33, formed therein along the length of the track member 21. Similarly, shoulders 31 and 31′ have channels 34 and 35 formed therein. Channels 32 and 34 define a receptor for conductor 22, the upper and lower edges 22*a* and 22*b* (FIG. 2) of which are maintained in place by rear or interior surfaces 29*a* and 31*a* of the shoulders 29 and 31. Similarly, channels 33 and 35 define a receptor for power supply conductor 23 with rear or interior surfaces 29*a*′ and 31*a*′ of shoulders 29′ and 31′ retaining the upper edge 23*a* and lower edge 23*b*, respectively, of conductor 23 in place of the support member 21.

For the purpose of mounting the support member 21 on a surface, such as a ceiling, the support member is provided with a plurality of mounting apertures 38 each defining recessed mount for screws 39. When the screws 39 are engaged by the mounting surface, they will automatically countersink into the apertures 38, as illustrated in FIG. 2 to enable flush mounting of the screws 39.

In accordance with a feature of the invention, the support member 21 is made of a semi-rigid elastomeric material which enables the member 21 to be bent, in one plane, to any configuration desired. One material suitable for the support member, commercially available from B. F. Goodrich is identified as GEON #8700A Vinyl. The conductors 22 and 23 are copper alloy 110 for example. As illustrated in FIG. 1, the member 21 is shown to exhibit a generally 90° bend at point A, another 90° bend in the opposite direction at point B, and a third 90° bend at point C. Referring to FIGS. 1 and 2, in accordance with the invention, the conductors 22, 23 have a height greater than their thickness, and therefore are oriented vertically to extend upwardly between walls 24 and 25 of support member 21. Thus, the track 20 can be bent or flexed in a plane running perpendicular to the height of the conductors. On the other hand, because of their broad extent height-wise, the conductors resist bending of the track 20 in a transverse plane.

Figure 5:
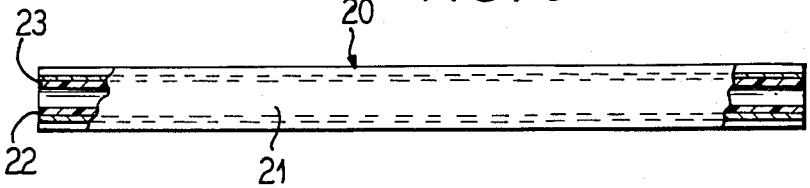
FIG. 5 is a top plan view of a section of track, partially cut away to illustrate the supply conductors.
Figure 6:
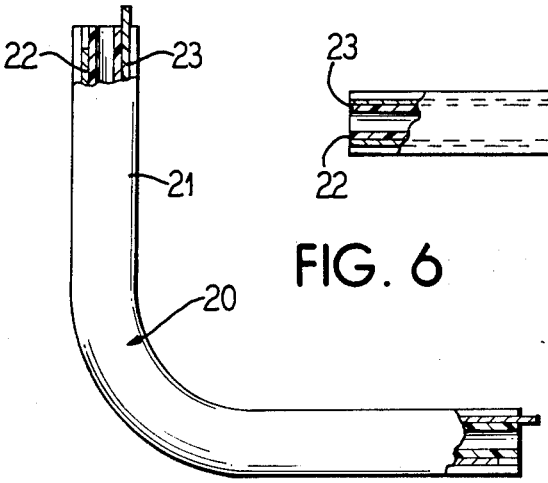
FIG. 6 illustrates the track section of FIG. 5 bent at a right angle.

Referring to FIGS. 5 and 6, which illustrate a portion of the track 20 cut away to illustrate the conductors 22 and 23, it is seen that when the track 20 is bent, the innermost conductor 23 has its ends projecting outwardly of the track member 21 because its inner track path is shorter due to the bend. The depth of the channels 32, 33 and 34, 35 and the resilience of the support member 21 are selected to assure that the conductors 22 and 23 are not pulled out of the retaining channels 32–35 when the track 20 is bent at a desired angle in a horizontal plane.

Referring now to FIGS. 7 and 8, there is illustrated the manner in which a pair of tracks can be connected together to double the length of the track. Referring first to FIG. 7, which illustrates two track sections 41 and 42 disposed in end to end relationship, track section 41 includes conductors 43 and 44 and track section 42 includes conductor 45 and a further conductor (not shown). An end 45*a* of conductor 45 overlaps conductor 44 when the track members 41 and 42 are placed in end-to-end relationship.

For the purpose of securing the track sections 41 and 42 together, there is provided a generally U-shaped connector 47 having a slot 48 extending longitudinally of the connector 47 and a pair of inwardly projecting ribs or cam surfaces 49 and 50, also extending the longitudinal length of the connector 47. The cam surfaces 49 and 50 are adapted to engage the overlapping sides of the conductors, the resilience of the connector 47 forcing the cam surfaces inwardly to squeeze the conductors therebetween. The connector 47 is shown in FIG. 8 assembled on the track members 41 and 42, holding them together.

In accordance with a feature of the invention, the track lighting system is a low voltage system. Transformers, such as surface mounted transformer assembly or module 51 illustrated in FIG. 9, or recessed mounted transformer assembly or module 52, shown in FIG. 11, are provided for stepping down conventional or existing electrical power at 110 VAC to a low level voltage, which may be 12 volts or 24 volts, for example.

Referring first to FIGS. 9, 9A, 9B and 10, the surface mounted transformer assembly 51 includes a base plate 53, a step down transformer 54, a back plate 55, a cover plate 56 and a cover support screw 57 engagable by a retaining nut 58. The transformer 54, which is mounted on the back plate 55, has leads 54*a*, 54*b* connectable to electrical power conductors of the wiring system in which the track lighting is employed. A connection arrangement 59 is provided in the back plate 55 to permit connection of a track 60 to the power output of the transformer. Conductors 61, 62 of the track project beyond an end of the track and are inserted through a cut-out area 63 in the cover plate 56. A finger 64 guides the conductors into engagement with connectors 65, 66 which in turn are connected to power leads 67, 68 from the transformer 54. A circuit breaker 69 may be provided in one of the power lead lines to protect the transformer.

Figure 11:
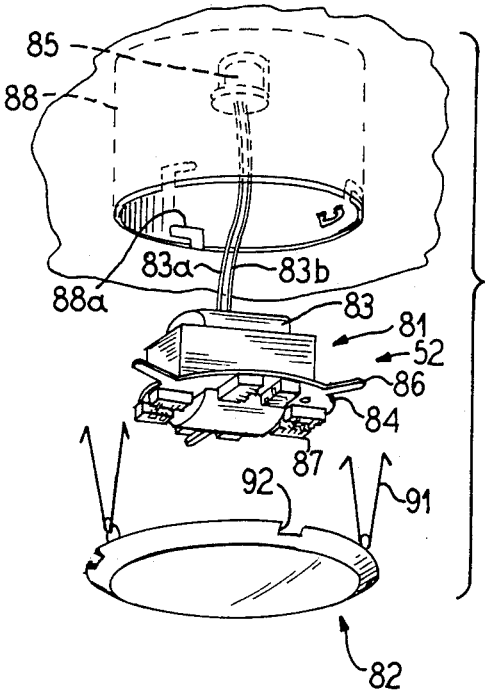
FIG. 11 is an exploded view of a recessed transformer fixture for energizing a track section.
Figure 12:
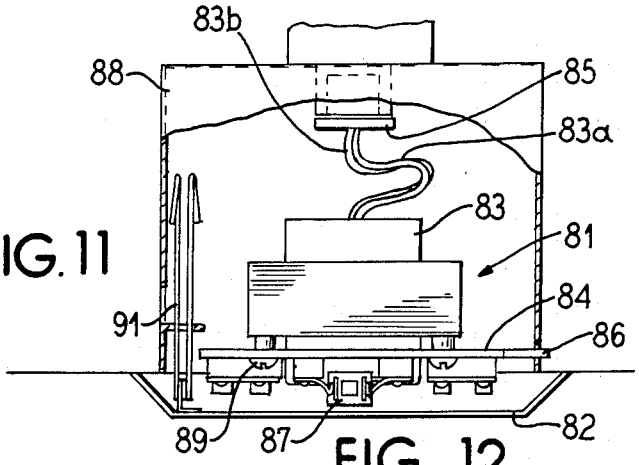
FIG. 12 is a side view of the transformer assembly of FIG. 11.
Figure 13:
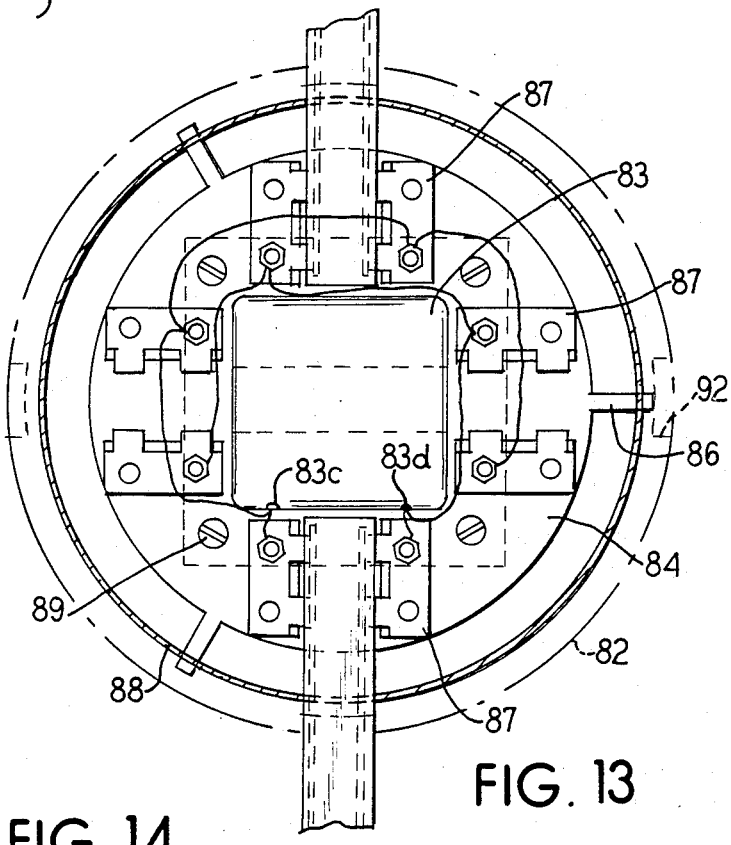
FIG. 13 is a bottom view of the transformer assembly of FIG. 11.

Referring now to FIGS. 11–13, the recessed transformer assembly 52 includes a transformer subassembly 81 and cover 82 which are adapted for mounting within an existing recessed fixture 88 in a ceiling. Transformer subassembly 81 includes a step down transformer 83, a base plate 84, a male socket adaptor 85, alignment or locking pins 86 and mounting terminals 87. The transformer 83 is mounted on the base plate 84 by mounting screws 89. Power input conductors 83*a*, 83*b* for the transformer are connected to male socket adaptor 85 which screws into an incandescent lamp socket in the recessed fixture 88 in the ceiling. Output terminals 83*c*, 83*d* of the transformer are connected by appropriate lines to the mounting terminals 87 for engagement by the power conductors of the track lighting system.

In assembling the recessed transformer assembly 62, the transformer socket adaptor 85 is first screwed into the incandescent lamp socket in the recessed fixture in the ceiling and the transformer base plate 84 is then raised into position and rotated to allow the locking pins 86 to lock into place in slots 88*a* provided in the recessed fixture 88. The cover plate 82 is then installed in a conventional manner by way of its hangers 91. The cover is provided with break away portions 92 at 90° locations along the periphery to facilitate passage of the track to the interior of the transformer assembly for connection to the transformer outputs.

Figure 16:
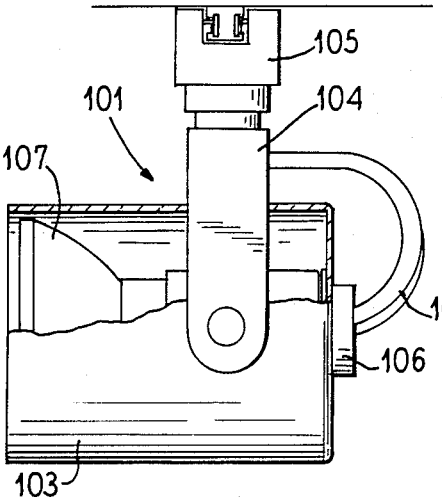
FIG. 16 is a side elevation view partially cut away of a lamp fixture including a power head in accordance with one embodiment of the invention.
Figure 17:
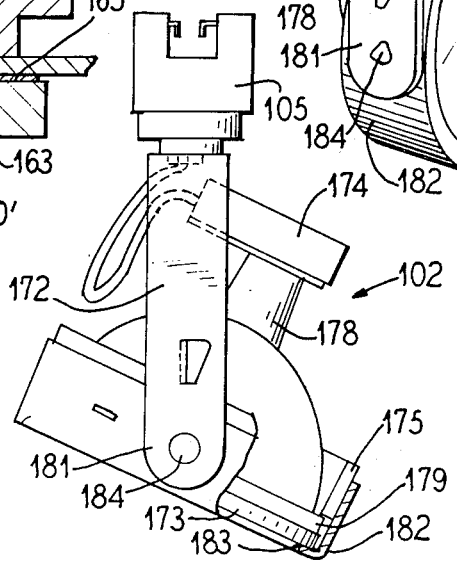
FIG. 17 is a side elevation view partially cut away of a lamp assembly provided in accordance with a second embodiment of the invention.

Referring now to FIGS. 14–18, there are illustrated embodiments for two lamp assemblies 101 (FIG. 16) and 102 (FIG. 17). Referring to FIG. 16, lamp assembly fixture 101 includes a housing 103, a mounting bracket 104, a power head connector 105, and a lamp socket 106 mounted on the housing and adapted to receive a lamp 107. The socket 106 has electrical conductors 108 which connect to the power head 105 which extend electrical power to the lamp socket 106.

Figure 14:
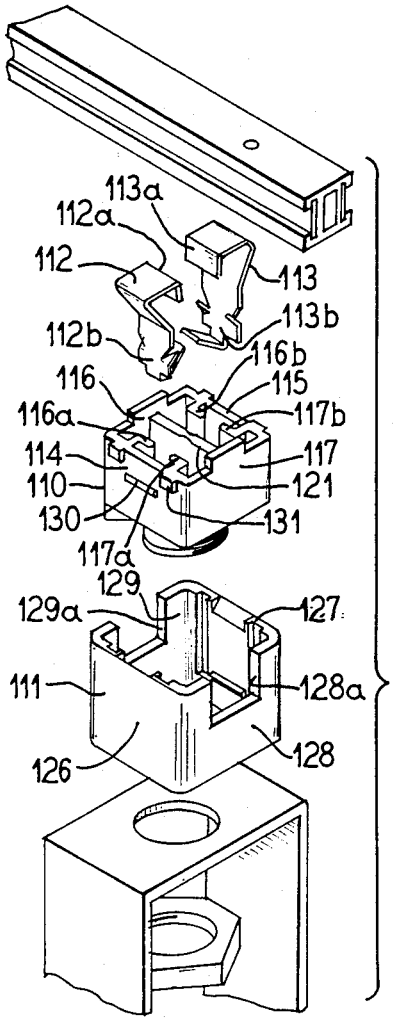
FIG. 14 is an exploded view of a section of track and the components of a power head.
Figure 15A:
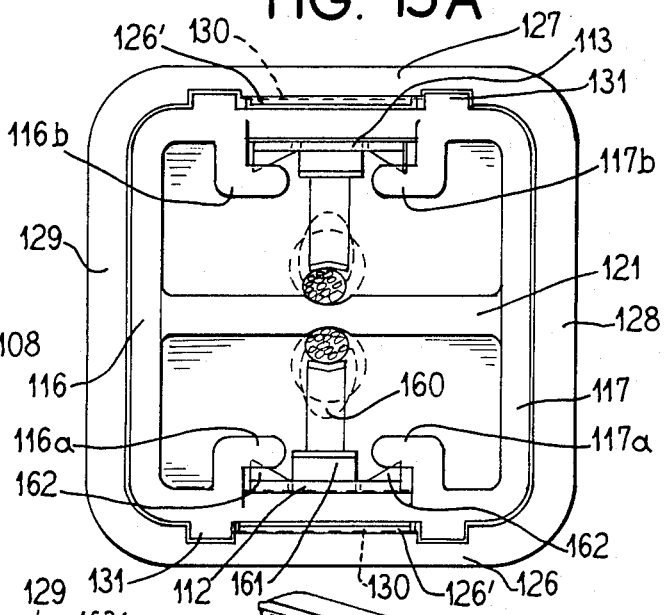
FIG. 15A is a top view of the power head of FIG. 5.
Figure 15:
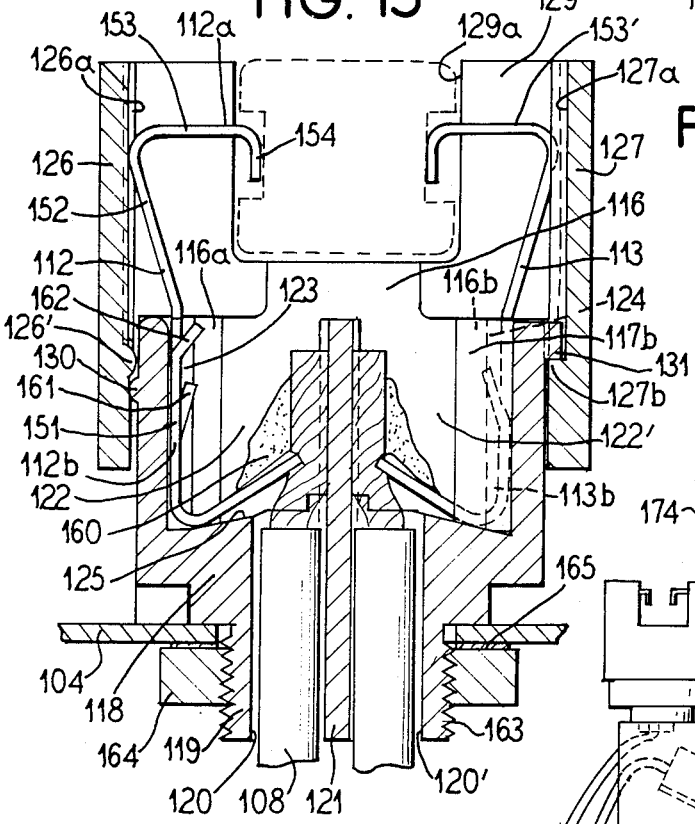
FIG. 15 in an enlarged side sectional view of a power head for a lamp fixture.

Referring to FIGS. 14 and 15, the power head 105 comprises a two-piece housing comprised of nesting members including base member 110 and slide member 111 and power head contacts 112 and 113 having respective contact portions 112*a*, 113*a* and respective mounting portions 112*b*, 113*b*. The base member 110 and the slide member 111 are preferably molded one-piece members. The slide member is mounted on and slidable along the base member between a latch position (FIG. 15) in which it surrounds the contact portions of the contacts driving them into engagement with the track and a release position in which it is located beneath the contact portions 112*a*, 113*a*, allowing them to spring back away from the track. The base member 110 is a generally hollow rectangular member having a pair of side walls 114, 115, rear and front walls 116, 117 (FIG. 14) and a bottom wall 118. The bottom wall defines a collar 119 which has a pair of conductor receiving channels 120, 120' defined by a transverse wall member 121 which divides the interior of the base member into two compartments 122, 122'.

The compartments 122 and 122' receive the mounting portions 112*b* and 113*b* of the contacts 112 and 113 which are secured to inner surfaces thereof. To this end, the rear wall 116 of the base member has a pair of inwardly extending ribs 116*a* and 116*b*, and a similar pair of inwardly extending ribs 117*a*, 117*b* projecting inwardly from the front wall 117. The ribs, such as rib 116*a* extends parallel to and spaced apart from the inner surface side wall 114 defining a channel 123 in which is received the mounting portion of the contact 112. A similar channel 124 is defined by rib 116*b* and the inside surface of side wall 115, which receives the mounting portion of contact 113. The inner surface of the bottom wall 118 slopes upwardly towards the center of the base member 105 defining ramped bearing surfaces 125 for the ends of the mounting portions 112*a* and 113*a* of the contacts 112 and 113.

Because of the contacts 112 and 113 are identical in shape, only contact 112 is described in detail. Contact 112 is a generally C-shaped member having a vertically extending portion 151 which is bent outwardly at a slight acute angle above its mid-point portion 152. The top edge 153 is bent over to extend horizontally and then bent downwardly at its tip 154 to extend vertically downward. This defines a contact portion 112*a* for the conductor. The bottom edge or mounting portion 112*b* of the contact is bent upwardly and extends inwardly to engage the end of the power conductor 108 and is attached thereto as by soldering 160. A pair of dogs 161 project inwardly and a third dog 162 located above the level of dog 161 projects into the slot defined between the rib 116*a* and 117*a*. Dogs 161 and 162 maintain the contact in place, the contact being effectively cantilever mounted from above dog 162 with its contact portion 154 projecting into engagement with the conductor when it is assembled on a track member.

When the mounting portions 112*b* and 113*b* of the contacts 112 and 113 are inserted into the channels 123 and 124, respectively, with the bottom portions of the contacts engaging the ramped surfaces 125, the dogs, such as dog 161, engage the side surface of the adjacent rib, such as rib 116*a*. The contact mounting portion 112*b* extends between the two opposing ribs such as rib 116*a* and the opposing rib (not shown) extending inward from the front wall of the base member. The contact portion 112*a* of the contact 112 projects out of the base member at the upper surface thereof.

The slide member 111 comprises a box-like member having side walls 126, 127, a front wall 128 and a rear wall 129, the slide member 111 being open ended at its upper and lower surfaces. The front and rear walls 128 and 129, respectively are provided with respective rectangular slots 128*a* and 129*a* for receiving the track section (represented by the dashed line in FIG. 15). The inner surfaces 126*a* and 127*a* of the side walls 126 and 127 act as cam surfaces to drive the contacting portions 153, 153' of the contacts 112 and 113 inwardly as the slide member 111 is moved upwardly to its latched position, to drive the contact portions into contact with the conductors of the track section. The inner surface of side walls 126 and 127 carry a transverse extending rib, such as rib 126' for side wall 126 which cooperates with a transverse rib 130 on the external surface of side wall 114 of the base member to maintain the slide member 111 in its extended position. A pair of laterally placed shoulders 131 projecting outwardly from the upper surface of side wall 114 define a limit stop for the slide member 111 and are positioned for engagement by shoulders 127*b* on the sidewalls as the slide member 111 is moved up to its latched position. The power head 105 has an externally threaded boss 163 which projects below the bottom wall 118 of the base member 110 to engage with a retaining nut 164 for clamping the power head onto the mounting bracket 104 of the lamp assembly. A wave washer 165 between the nut 164 and the bracket 104 assures retention of the nut against the bracket.

To attach the lamp assembly 101 to a track section, the slide member 111 is positioned at its lower or released position. At such position, because of their resilience, the contacts 112 and 113 are biased outwardly away from one another. The power head connector is positioned to locate its contacts 112 and 113 on either side of the track section and the slide member 111 is then moved upwardly to its latched position, the inner cam surfaces of the slide member 111 driving the contacts 112 and 113 into engagement with the conductors on the track section. When the slide member 111 is at its latched position, ribs 126′ cooperate with projections 130 and shoulders 131 and 127*b* engage to maintain the slide member 111 in its fully extended position with the contacts 112 and 113 biased into engagement with the conductors of the track section. The contacts both connect the power head assembly and its functional device to the track section and extend electrical power to the device.

Figure 18:
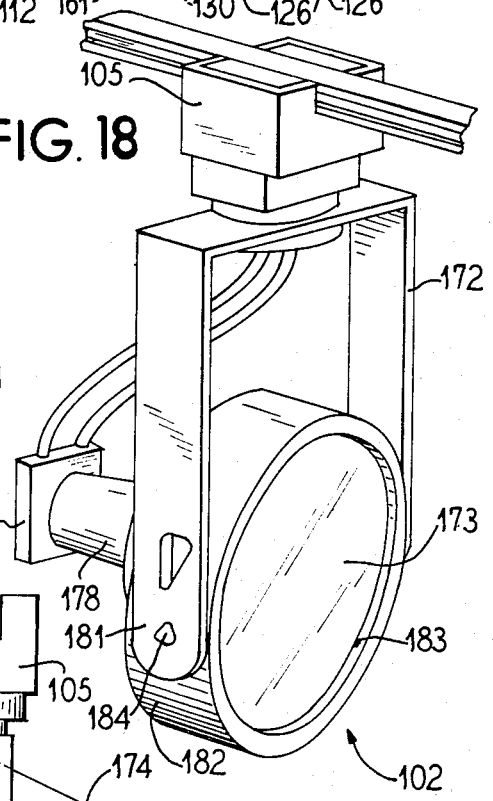
FIG. 18 is a perspective view of the lamp fixture of FIG. 17 attached to a track.

Referring to FIGS. 17 and 18, which illustrates the second embodiment for a lamp assembly 102 provided by the present invention. The lamp assembly 102 includes a power head connector 105 which is identical with that included in the lamp assembly 101 shown in FIG. 16 and accordingly will not be described in detail. Lamp assembly 102 further includes a yoke or fixture 172, a lens 173, a lamp socket 174 and a retainer 175. The lamp socket 174 is adapted to receive the end of a standard incandescent spot light or flood light 178 having a flat circular end portion 179. The lens 173 is approximately the same diameter as the end 179 of the lamp 178. The fixture 172 includes a yoke portion 181 and a circular frame portion 182 having a forward ridge 183. The frame 182 is attached to the yoke 181 by pivot assembly 184.

To assemble the lamp assembly 102, the lamp 178 is screwed into the socket 174. The lens 173 is placed in the retainer 182 and the lamp 178 is positioned in the frame with its front edge located on the lens. The retainer member 175 is then inserted from the rear and wedged between the inner surface of the retainer frame 183 and the outer edge of the lamp 178, securely holding the lamp in the fixture. The assembled lamp fixture 102 is attached to the track by its power head connector 105 in the manner described above with reference to lamp assembly 101 shown in FIG. 16.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. In a track lighting system, the combination comprising:

power track means including an elongated support member of an electrical insulating material having first and second channels formed in opposite sides thereof and extending the length of said support member, and first and second elongated strip conductors of electrically conducting material supported in said first and second channels, respectively, said conductors extending substantially the entire length of said channels;

power means connecting strip conductors to a source of electrical power for energizing said conductors; and a light fixture assembly including socket means for receiving a lamp, power head connector means connected to said socket means and constructed and arranged for attachment to said power track means, and support means for supporting at least said power head connector means; said power head connector means including a two-piece housing having a base member and a slide member, and first and second flexible electrical contacts, said contacts having mounting portions and contact portions, said base member defining mounting channels for mounting said contacts by their mounting portions in a parallel spaced relation at opposite sides of said base member, said slide member mounted on said base member for slidable movement along the outer surface thereof between a release position and a latch position to engage said contact portions thereby, flexing said contact portions of said contacts towards one another into engagement with said strip conductors for connecting said light fixture assembly to said power track means mechanically and electrically by said contacts, and said slide member being movable between the latch position and the release position to disengage from said contact portions, allowing them to flex away from one other to disconnect said light fixture assembly from said power track means.

2. A system according to claim 1, wherein said support member is of a flexible material, said support member and said strip conductors being bendable in a first plane, said strip conductors are oriented vertically edgewise within said channels preventing bending of said support member in a plane perpendicular to said first plane.

3. A system according to claim 1, wherein said support member has a generally I-shaped cross-section with generally flat top and bottom strip portions extending in parallel spaced relationship the length of said support member, a vertical wall portion extending the length of said support member between said top and bottom portions and having lateral surfaces recessed relative to the edges of said top and bottom portions, and said top and bottom portions having respective downwardly and upwardly extending projections near the edges thereof for retaining said conductors in said channels.

4. A system according to claim 1, wherein said power means comprises support means adapted for attachment to a wall or ceiling surface, power transformer means mounted on said support means and having input terminals connected to a source of electrical power and output terminals, contact means disposed on said support means and connected to said output terminals, said contact means adapted to engage said strip conductors to extend electrical power thereto, and housing means mounted on said support means enclosing said power transformer means.

5. A system according to claim 1, wherein said power means is mounted within a recessed fixture located in a wall or ceiling surface, said power means comprising support means, power transformer means mounted on said support means and having input terminals connected to a male socket adapter which is adapted to be received in a socket of the recessed fixture for connecting electrical power provided thereat to said input terminals and output terminals, first and second contacts disposed on said support means and connected to said output terminals, said contacts constructed and arranged to engage said first and second strip conductors, respectively, connecting said conductors to said output terminals, and cover means mounted on an open end of said recessed fixture enclosing said transformer means therewithin.

6. A system according to claim 1, wherein said housing of said power connector means includes latch means for maintaining said slide member in the latch position.

7. A system according to claim 1, wherein said slide member defines a longitudinal channel near the upper edge thereof which locates said power track means when said power connector means is mounted thereon, said contact portions each having a first contact portion extending upwardly at an angle into the line of travel of said slide member, a second contact portion extending generally horizontal in cantilever fashion from the upper end of said first contact portion towards said channel, and a third contact portion extending downward from the free end of said second contact portion for engaging said conductive strips when said slide member is in the latch position.

8. A system according to claim 7, wherein said support member defines first and second rails extending along substantially the entire length thereof on opposite sides thereof, said third contact portions engaging said rails when said slide member is in the latch position to suspend said fixture from said power track means.

9. A power track section for mounting at least one electrical device and for extending electrical power to the electrical device, comprising:

an elongated support member of a semi rigid electrical insulating material;

first and second elongated electrical conductors;

said support member having a generally I-shaped cross-section and defining first and second vertical channels extending the length of said support member on opposite sides thereof;

said first and second conductors located in said first and second channels, respectively, and extending substantially the length of said support member, said conductors oriented vertically edgewise in said channels to define electrical conducting surfaces along opposite sides of said support member along the length thereof, said support member and said conductors supported thereby being bendable in a first plane, and said edgewise oriented conductors preventing bending of said support member in a plane perpendicular to said first plane.

10. A power track section assembly according to claim 9, wherein said support member defines first and second side rails at the outer edges of said channels and extending the length thereof for maintaining said conductive strips within said channels.

11. A power track section according to claim 10, wherein said support member has a plurality of mounting apertures formed therethrough to facilitate mounting of the support member to a ceiling or wall surface.

12. A power track section for mounting at least one electrical device and for extending electrical power to the electrical device, comprising:

an elongated support member of an electrically insulating material;

first and second flat elongated electrical conductors; and said support member being generally I-shaped having top and bottom portions with a vertical intermediate wall portion extending therebetween maintaining said top and bottom portions in a parallel spaced relation, the width of said top and bottom portions being greater than the width of said intermediate wall portion on both sides thereof defining first and second lateral recesses extending the length of said support member, said first and second conductors located in said first and second recesses respectively, and extending substantially the length of said support member and oriented vertically edgewise in said recesses to define electrically conducting surfaces along opposite sides of said support member along the length thereof, said top and bottom portion having respective downwardly and upwardly extending projections at ends thereof for retaining said conductors in said recesses, said support member and said conductors supported thereby being bendable in a first plane, and said vertically oriented conductors preventing bending of said support member in a plane perpendicular to said first plane.

13. A power track section according to claim 12, wherein said intermediate wall is provided with a plurality of mounting apertures therethrough between said bottom and top portions and spaced along the length thereof to facilitate mounting of the power track section to a ceiling or wall surface.

14. A power track section according to claim 12, wherein said intermediate wall has a hollow core extending the length thereof between said top and bottom portions of said support member, and said top and bottom portions of said support member being provided with a plurality of aligned mounting apertures spaced along the length thereof to facilitate mounting of the power track section to a ceiling or wall surface.

15. In a power track assembly for mounting at least one electrical device and for extending electrical power to the electrical device, the combination comprising:

first and second power track sections each including an elongated support member defining first and second vertical channels extending the length of said support member on opposite sides thereof;

first and second flat elongated electrical conductors for each support member located in the channels thereof oriented vertically and extending the length of said support member, the conductors of one of said support members having end portions extending beyond the length of said one support member whereby when said first and second support members are assembled in an end-to-end relationship, the end portions of the conductors of said one support member overlap a portion of the conductors of the other one of said support members; and connector means constructed and arranged to engage the overlapping conductors of said support members, urging said conductors of said one support member into engagement with said conductor of said other support member.

16. In a power track assembly for mounting at least one electrical device to a wall or ceiling surface and for extending electrical power to the electrical device, the combination comprising:

a power track section including an elongated support member defining first and second channels in opposite sides thereof, extending the length of said support member, and first and second flat elongated strip conductors of electrically conducting material supported in said first and second channels, respectively;

a power step-down transformer means coupling said strip conductors to a source of electrical power for energizing said strip conductors, support means mounting said transformer means within a recessed fixture located in said wall or ceiling surface, said transformer means having input and output terminals, a male socket adapter connected to said input terminals and adapted to be received in a socket of the recessed fixture for connecting electrical power provided thereat to said transformer input terminals, first and second contact means disposed on said support means and connected to said output terminals, said contact means constructed and arranged to engage said first and second strip conductors, respectively, connecting said conductors to said transformer output terminals; and cover means mounted on an open end of said recessed fixture enclosing said transformer means therewithin.

17. An assembly according to claim 16, wherein said support means comprises a circular plate-like mounting member, said first and second contact means including at least respective first and second contacts disposed on said mounting member at diametrically opposed locations thereof, said cover means defining first and second channels at diametrically opposed locations at peripheral edges thereof to enable said power track section to pass through said cover with said strip conductors engaging said contacts.

18. In a power track assembly for mounting at least one electrical device to a wall or ceiling surface and for extending electrical power to the electrical device, the combination comprising:

a power track section including an elongated support member having first and second channels in opposite sides thereof and extending the length of said support member, and first and second flat elongated strip conductors of electrically conducting material supported in said first and second channels, respectively, and means for securing said power track section to the wall or ceiling surface;

a power step down transformer means coupling said strip conductors to a source of electrical power for energizing said strip conductors, said power transformer means having an input circuit hard-wired to a source of electrical power and an output circuit including first and second contact means constructed an arranged to engage said first and second strip conductors, respectively, extending electrical power thereto, and housing means enclosing the transformer means and adapted for attachment to the wall or ceiling surface on which said power track section is mounted.

19. A light fixture assembly for use in a power track system of the type including a power track means having first and second electrical power conductors coupled to a source of electrical power for energization thereby;

said light fixture assembly comprising:

a socket means for receiving a lamp;

power head connector means connected to said socket means and constructed and arranged for attachment to said power track means to connect said light fixture assembly to the power track means;

and support means for supporting at least said power head connector means;

said power head connector means including a housing having a base member mounting first and second contacts therein and a slide member slidable along said base member between a released position where said contacts are out of engagement with said power conductors and a latched position where said slide member moves contacts into engagement with said power conductors and securing said light fixture assembly to the power track means.

20. A light fixture assembly according to claim 19, wherein said housing of said power connector means includes latch means for maintaining said slide member in the latched position.

21. A light fixture assembly according to claim 19, wherein each of said contacts includes a mounting portion and a contact portion, said base member defining first and second mounting channels for receiving said mounting portions of said contacts, said mounting portions of said contacts having means engaging inner surfaces of said mounting channels for securing said contacts to said base member.

22. A light fixture assembly according to claim 21, wherein said power conductors include first and second elongated strip conductors of electrically conducting material supported by a support member, and wherein said slide member defines a longitudinal channel near the upper edge thereof which locates said power track means when said power connector means is mounted thereon, said contact portions each having a first contact portion extending upwardly at an angle into the line of travel of said slide member, a second contact portion extending in cantilever fashion generally horizontal from the upper end of said first contact portion towards said channel, and a third contact portion extending downward from the free end of said second contact portion for engaging said conductive strips when said slide member is in the latched position.

23. A light fixture according to claim 19, wherein said support means includes a yoke having a base portion and first and second parallel extending arm portions, lamp mounting means extending between said arm portions and pivotally attached thereto, and said power head connector means attached to said base portion.

* * * * *